US012071279B2

(12) United States Patent
Koutal

(10) Patent No.: US 12,071,279 B2
(45) Date of Patent: Aug. 27, 2024

(54) VIAL CLOSURE ASSEMBLY

(71) Applicant: WEST PHARMACEUTICAL SERVICES, INC., Exton, PA (US)

(72) Inventor: Benny Cyrus Koutal, Wayne, PA (US)

(73) Assignee: West Pharmaceutical Services, Inc., Exton, PA (US)

( * ) Notice: Subject to any disclaimer, the term of this patent is extended or adjusted under 35 U.S.C. 154(b) by 397 days.

(21) Appl. No.: 17/628,582

(22) PCT Filed: Jul. 22, 2020

(86) PCT No.: PCT/US2020/043031
§ 371 (c)(1),
(2) Date: Jan. 20, 2022

(87) PCT Pub. No.: WO2021/016328
PCT Pub. Date: Jan. 28, 2021

(65) Prior Publication Data

US 2022/0250803 A1 Aug. 11, 2022

Related U.S. Application Data

(60) Provisional application No. 62/877,473, filed on Jul. 23, 2019.

(51) Int. Cl.
*B65D 41/28* (2006.01)
*B65D 51/24* (2006.01)

(52) U.S. Cl.
CPC ..... *B65D 41/28* (2013.01); *B65D 51/241* (2013.01)

(58) Field of Classification Search
CPC .... B65D 51/20; B65D 51/241; B65D 51/002; B65D 55/02; B65D 41/28; B65D 53/02; A61J 1/00; A61J 1/1412
(Continued)

(56) References Cited

U.S. PATENT DOCUMENTS 4,267,925 A * 5/1981 Crankshaw ..... B65D 25/082 215/DIG. 8
5,085,332 A * 2/1992 Gettig ..... B65D 55/0872 215/277
(Continued)

FOREIGN PATENT DOCUMENTS

CN 109279203 A 1/2019
EP 3 326 932 A1 5/2018
(Continued)

*Primary Examiner* — Chun Hoi Cheung
*Assistant Examiner* — Brijesh V. Patel
(74) *Attorney, Agent, or Firm* — Blank Rome LLP

(57) ABSTRACT

A vial closure assembly for sealing a container includes a ring, a cap, a shell, and an optional cover. The ring has a first top wall defining a first through-opening and a skirt extending downwardly from the first top wall that includes a plurality of locking tabs. The cover includes a second top wall defining a second through-opening, a sidewall extending downwardly from the second top wall, and an interior cavity defined by the second top wall and the sidewall. The cap includes a plurality of tabs configured to engage the first or second top wall. The shell includes a body having an inwardly radially extending upper and lower lip. The upper lip includes at least one rail for sliding contact with a top surface of either the first or second top wall.

21 Claims, 2 Drawing Sheets

(58) Field of Classification Search
USPC ..... 215/247, 277
See application file for complete search history.

(56) References Cited

U.S. PATENT DOCUMENTS

| | | | | |
|---|---|---|---|---|
| 5,555,988 | A * | 9/1996 | Koch | B65D 51/002 215/249 |
| 5,957,314 | A * | 9/1999 | Nishida | B65D 45/322 220/257.1 |
| 8,714,384 | B2 | 5/2014 | Aneas | |
| 8,777,031 | B2 | 7/2014 | Aneas | |
| 8,839,971 | B2 * | 9/2014 | Aneas | B65D 51/241 215/350 |
| 8,950,609 | B2 * | 2/2015 | Aneas | A61J 1/1425 215/277 |
| 8,978,909 | B2 * | 3/2015 | Kakutani | B65D 51/002 215/296 |
| 9,260,227 | B2 | 2/2016 | Kawamura et al. | |
| 9,555,941 | B2 * | 1/2017 | Ogawa | A61J 1/1425 |
| 9,815,601 | B2 * | 11/2017 | Browne | A61J 1/1406 |
| 10,183,791 | B2 * | 1/2019 | Friedrich | B65D 51/002 |
| 10,219,983 | B2 * | 3/2019 | Zelinski | A61J 1/2096 |
| 2013/0240476 | A1 | 9/2013 | Aneas | |
| 2014/0034646 | A1 * | 2/2014 | Lanier | B65D 51/002 220/361 |

FOREIGN PATENT DOCUMENTS

| | | | |
|---|---|---|---|
| JP | 2011511741 | A | 4/2011 |
| WO | 2017/001459 | A1 | 1/2017 |
| WO | 2019/144067 | A1 | 7/2019 |

* cited by examiner

VIAL CLOSURE ASSEMBLY

CROSS-REFERENCE TO RELATED APPLICATIONS

This application is a National Stage of International Patent Application No. PCT/US2020/043031, filed on Jul. 22, 2020, which claims the benefit of and priority to U.S. Provisional Patent Application No. 62/877,473, titled "Vial Closure Assembly," filed on Jul. 23, 2019, the entire contents of which are incorporated herein by reference in their entirety.

BACKGROUND

A vial closure assembly including a shell configured to be connected to a vial for holding a stopper in place relative to the vial, in order to ensure adequate isolation of the contents of the vial and stopper from the outside and surrounding environment is provided. Another embodiment relates to a container equipped with such a vial closure assembly.

In the field of containers for medication, a glass bottle can be used to store an active ingredient in freeze-dried form, in powder form, or in the form of a liquid solution. Such a bottle must be closed off in a leak-tight manner, so as to maintain its contents in a satisfactory state of preservation, until the date on which it is used. In order to close a bottle hermetically, a vial closure assembly can be used that comprises an elastomer stopper that has the function of being totally sealed against gas, liquids, and bacteria. Such a device further comprises a locking cover that can be made of a plastic material, and that is designed to be held in place around the stopper so as to isolate the stopper from the outside and so as to oppose removal of the stopper.

When the cover needs to be moved so as to be locked around the neck of the corresponding container, friction creates resistance to this movement, the magnitude of which varies as a function firstly of the manufacturing tolerances of the component parts of the cover, and secondly of the pre-positioning of the parts when they are installed on the neck of the container. Thus, when a presser plate is used to lock the covers on a large number of corresponding containers, certain covers are not locked correctly in view of the manufacturing tolerances of the component parts of the covers and in view of the operating clearances of the presser plate. Also, the dimensional variations in the containers themselves and in the stoppers that are used further complicate the closure of a batch of containers. Furthermore, rotational movement of the cover and stopper relative to the vial, particularly for plastic closure assemblies, may cause breaches in the desired isolation of the contents of the vial.

Therefore, it is desirable to use a stopper device which provides for secure and stable positioning of the cover on a vial stopper and is configured so as to minimize the chances of the cover and stopper rotating relative to the vial. More particularly, it would be desirable to provide a vial closure assembly which is configured such that it would be difficult for an individual to rotate the stopper relative to the vial.

BRIEF SUMMARY OF THE DISCLOSURE

According to one aspect, a vial closure assembly comprises a ring, a cover, a cap, and a shell. The ring comprises a first top wall and a skirt extending downwardly from the first top wall, and the first top wall defines a first central through-opening. The skirt comprises a plurality of locking tabs. The cover comprises a second top wall, a sidewall extending downwardly from the second top wall and an interior cavity defined by the second top wall and the sidewall. The second top wall defines a second central through-opening generally aligned with the first central through-opening of the ring. The cap comprises a plurality of tabs configured to engage the second top wall of the cover. The shell comprises a barrel-shaped body having an inwardly radially extending upper lip and an inwardly radially extending lower lip, such that the shell is configured to captivate the cover. The upper lip includes at least one rail for sliding contact with a top surface of the second top wall.

According to another aspect, a vial closure assembly comprises a ring, a cap, and a shell. The ring comprises a top wall and a skirt extending downwardly from the top wall. The first top wall defines a first central through-opening, and the skirt comprises a plurality of locking tabs. The cap comprises a plurality of tabs configured to engage the top wall of the ring. The shell comprises a barrel-shaped body having an inwardly radially extending upper lip and an inwardly radially extending lower lip, such that the shell is configured to captivate the ring. The upper lip includes at least one rail for sliding contact with a top surface of the top wall.

These and other aspects of the various embodiments disclosed herein will be apparent in view of the following description.

BRIEF DESCRIPTION OF THE SEVERAL VIEWS OF THE DRAWINGS

The foregoing summary, as well as the following detailed description will be better understood when read in conjunction with the appended drawings. There are shown in the drawings embodiments which are presently preferred. It should be understood, however, that the disclosure is not limited to the precise arrangements and instrumentalities shown. In the drawings.

DETAILED DESCRIPTION OF THE DISCLOSURE

Figure 1:
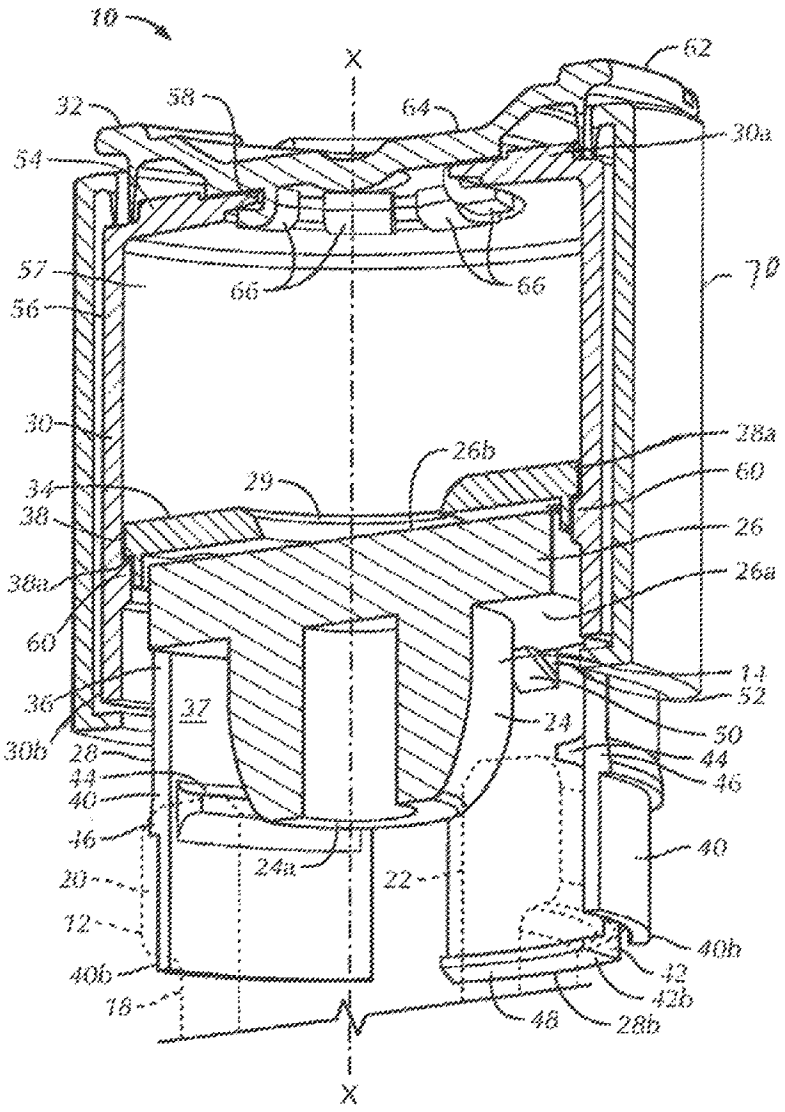
FIG. 1 is a cross-sectional bottom perspective view of a vial closure assembly on a container in a first position, in accordance with an embodiment of the present invention.

Referring generally to the figures, the various embodiments disclosed herein relate to a vial closure assembly to be positioned on a container for closure of the vial in a leak-tight and secure manner. The vial closure assembly includes a ring, a cover, a shell, and a stopper assembled thereto. The stopper is configured to be positioned at least partially in the container. Preferably, the stopper is an elastomeric stopper. The stopper is substantially T-shaped in cross-section, and has a cylindrical body and a head. The cylindrical body is designed to be positioned within the neck of the container. The head defines a peripheral flange for abutting against the top surface of the rim of the container.

The ring, cover, and shell have a substantially cylindrical shape, a first end and an opposing second end. Once the stopper is inserted within the interior of the ring, the assembly can be press fit onto the crown of a vial until the stopper flange is compressed against the vial crown at a stopper/vial interface surface. The vial closure assembly, specifically the shell, is configured to hinder rotation of the stopper relative to the vial.

In one embodiment, the ring may include a plurality of locking tabs which are elastically deformable, and more particularly radially deformable (inwardly or outwardly) relative to a central longitudinal axis X of the tubular sidewall. The locking tabs are preferably configured to engage the rim of the vial when the vial closure assembly is in the sealed position. The ring may further include a tongue or prong configured to engage the stopper for securing the stopper within the interior cavity of the ring. The tongue or prongs are preferably cantilevered and inclined with respect to the interior surface of the respective leg. Each tongue is also biased at such an incline toward the interior cavity of the shell. Alternatively and/or in addition, the stopper may be retained within the ring by other means, such as by an interference fit.

In another embodiment, the vial closure assembly device includes an optional inner cover configured to surround and engage the ring.

It will be understood that the various embodiments disclosed herein are not limited to the aforementioned components of the vial closure assembly and need not include all of the aforementioned elements.

The vial closure assembly further includes an outer shell that surrounds the ring (and the inner cover if present). The outer shell is preferably the outermost portion of the vial closure assembly and therefore, the portion that a user is most likely to grip and apply a rotational torque. The outer shell is configured in such a way that it cannot be removed from the shell, but also such that it does not transfer external torque applied to the outer shell to the inner components of the vial closure assembly. The outer shell is designed to rotate freely with minimal friction between the internal surface of the outer shell and the external surface of the ring (or inner cover if present). The vial closure assembly therefore reduces the chances of rotation of the stopper (and ring) relative to the vial, and therefore reduces the chances of breaching an adequate sealing surface between the stopper and vial opening (i.e., the sealing surface at the stopper/vial interface). Because the outer shell covers all or almost all of the ring (or the inner cover if present), the vial closure assembly makes it more difficult for an individual to gain direct access to the stopper to twist or rotate the stopper relative to the vial.

In one embodiment, the outer cover is produced from a polymer material by an injection molding process.

Figure 2:
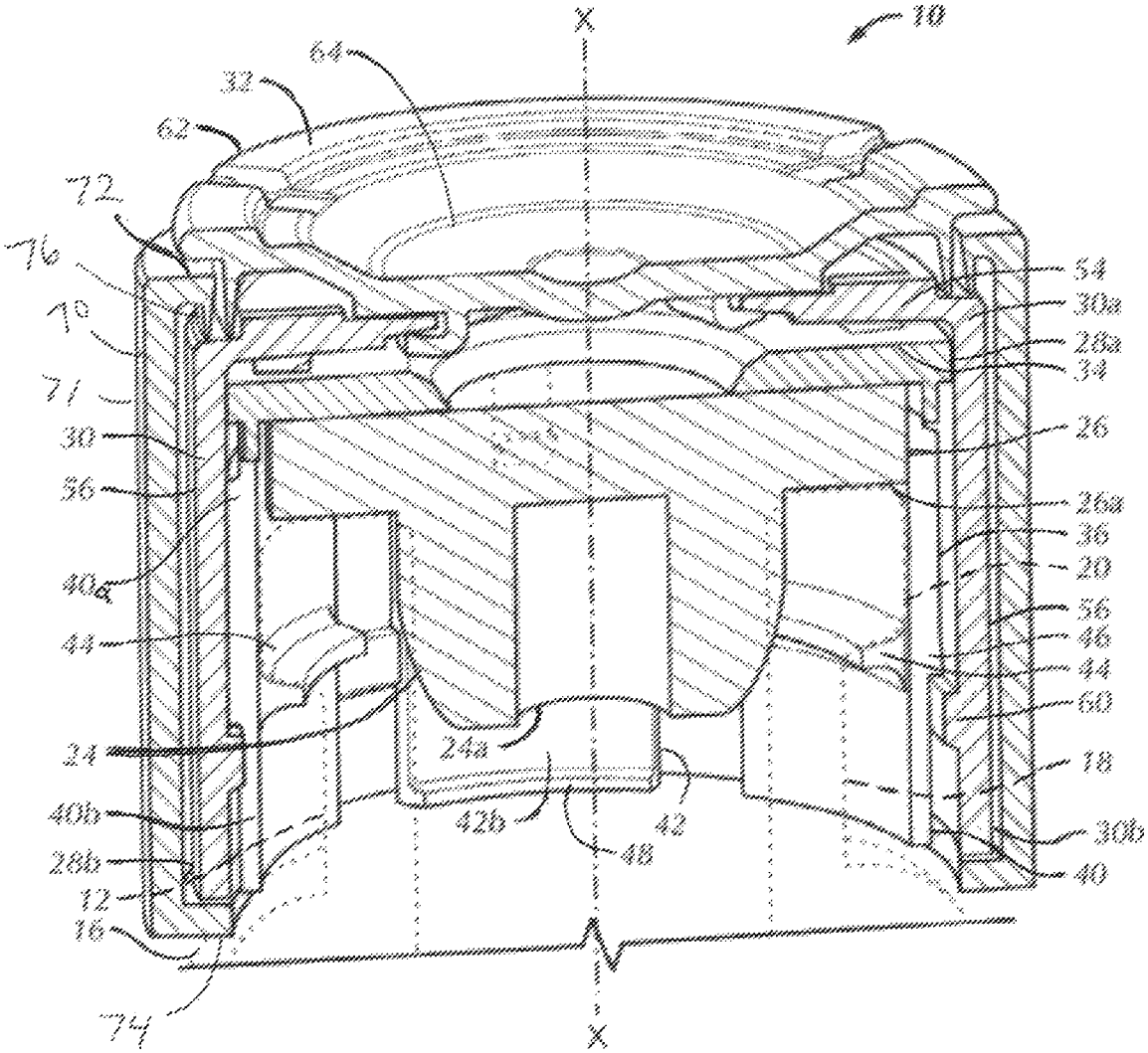
FIG. 2 is a cross-sectional top perspective view of the vial closure assembly on the container in the second position, in accordance with an embodiment of the present invention.

Now, referring specifically to FIGS. 1 and 2, there is shown a vial closure assembly, generally designated by the reference numeral 10, positioned on a container 12 for closure of the container 12 in a leak-tight and secure manner. The container 12 has a main body 16, a neck 18 extending from an upper end of the main body 16, and a rim 20 defining an opening 22 of the container 12 in communication with the neck 18 and body 16. The container 12 may be made of a glass, ceramic or a polymeric material, such as polyethylene (PE) polyethylene terephthalate (PET), glycol-modified polyethylene terephthalate (PETG), high density polyethylene (PEHD) and the like.

The vial closure assembly 10 shown in FIGS. 1 and 2 includes a stopper 14 assembled thereto. The stopper 14 is configured to be positioned at least partially in the container 12. Preferably, the stopper 14 is an elastomeric stopper. The stopper 14 is substantially T-shaped in cross-section and has a cylindrical body 24 and a head 26. The cylindrical body 24 is designed to be positioned within the neck 18 of the container 12. A free end 24*a* of the cylindrical body 24 is preferably tapered. The head 26 defines a peripheral flange for abutting against the top surface of the rim 20 of the container 12.

The vial closure assembly 10 is configured to cover the rim 20 and neck 18 of the container 12 and preferably with at least a portion of the stopper 14 positioned therein. The vial closure assembly 10, and more particularly each component of the vial closure assembly 10 as described in detail herein, is preferably made of a plastic material, and more preferably a thermoplastic material such as, but not limited to, PE, PET, PETG, PEHD, polypropylene (PP) or acrylonitrile butadiene styrene (ABS). More preferably, the vial closure assembly 10 is made of a pharma grade polypropylene material, and more particularly a pharma grade polypropylene material that is free of contaminants or critical substances (e.g., bisphenol A or formaldehyde).

According to one embodiment, the vial closure assembly 10 comprises a ring 28, a cover 30, a cap or sealing button 32, and a shell 70.

Referring to FIGS. 1 and 2, the ring 28 has a cylindrical shape has a first end 28*a* and an opposing second end 28*b*. The ring 28 comprises a top wall 34 at its first end 28*a* and cylindrical skirt 36, and more particularly a cylindrical skirt 36, extending downwardly from the top wall 34 away from the first end 28*a*. The ring 28 has an interior cavity 37 defined by the top wall 34 and the skirt 36. The second end 28*b* of the ring 28 is an open end. The top wall 34 includes an opening 29 at its geometric center. The opening 29 extends completely through the top wall 34 and is configured to be generally aligned with the opening 22 of the container 12. The top wall 34 has a diameter that is substantially the same as or at least slightly greater than a diameter of the skirt 36. Preferably, the diameter of the top wall 34 is at least slightly greater than the diameter of the skirt 36, such that a peripheral rim 38 of the top wall 34 juts out from a vertical plane of the skirt 36 and defines a peripheral flange.

The skirt 36 preferably comprises a plurality of locking tabs configured to capture the rim 20 of the vial 12 when the vial closure assembly 10 is in the sealed condition. In one embodiment, the plurality of locking tabs comprise a plurality of spaced-apart first walls or legs 40 and a plurality of spaced-apart second walls or legs 42. In a preferred embodiment, the plurality of spaced-apart first legs 40 includes three first legs 40 and the plurality of spaced-apart second legs 42 includes three second legs 42, meaning a total of six, preferably alternating, spaced-apart first and second legs 40, 42 form the skirt 36. Each first leg 40 and each second leg 42 has a first or proximal end 40*a*, 42*a* integrally formed with or attached to the top wall 34 and an opposing second or distal end 40*b*, 42*b* which is a free end. The first and second legs 40, 42 are elastically deformable, and more particularly radially deformable (inwardly or outwardly) relative to a central longitudinal axis X of the skirt 36. The central longitudinal axis X of the skirt 36 also defines a central longitudinal axis of the overall vial closure assembly 10. The first and second legs 40, 42 are preferably arranged in an alternating fashion relative to each other, meaning that each first leg 40 is positioned between two of the second legs 42 and, similarly, each second leg 42 is positioned between two of the first legs 40. As such, the skirt 36 is formed of alternating first legs 40 and second legs 42.

An interior surface of each first leg 40 includes a rib or ledge 44 protruding inwardly toward the interior cavity 37 of the ring 28. Each ledge 44 defines a catch designed to engage the rim 20 of the container 12, for example, before and during final closure and sealing of the container 12, as described in more detail herein. The ledge 44 is preferably provided at an intermediate position between the first and second ends 40*a*, 40*b* of each first leg 40 (i.e., each ledge 44 is distal from both the first and second ends 40*a*, 40*b* of the respective first leg 40). The ledges 44 of the first legs 40 are referred to hereinafter as upper ledges 44. An exterior surface of each first leg 40 includes a ledge 46 protruding outwardly away from the interior cavity 37 of the ring 28. Preferably, the ledge 46 of each first leg 40 is provided at a corresponding position to the upper ledge 44 of the respective first leg 40. Such an outwardly protruding ledge 46 may also be provided on the exterior surface of each second leg 42 at the same position and orientation, such that the plurality of outwardly protruding ledges 46 collectively define an annular outwardly protruding ledge.

The first legs 40 and second legs 42 are different from each other. More particularly, the second legs 42 do not include the same type of intermediately-positioned ledge 44 as the first legs 40. Rather, at or proximate the second end 42*b* of each second leg 42, each second leg 42 includes or is formed as a rib or ledge 48 which protrudes inwardly toward the interior cavity 37 of the ring 28. As such, the ledge 48 of each second leg 42 defines another catch designed to engage the rim 20 of the container 12, for example, during a treatment process, as described in more detail herein. The ledges 48 of the second legs 42 are referred to hereinafter as lower ledges 48. The distance between the upper ledges 44 of the first legs 40 and the lower ledges 48 of the second legs 42 is generally equal to or at least slightly larger than the height of the rim 20 of the container 12.

The interior surface of each second leg 42 further comprises a tongue 50 (alternatively may be referred to as a tab, prong, tooth and the like), and more particularly a flexible tongue 50, and a corresponding recess 52 configured to receive the tongue 50 when the tongue 50 is in a retracted configuration. Each tongue 50 is cantilevered and is inclined with respect to the interior surface of the respective second leg 42. Each tongue 50 is biased at such an incline toward the interior cavity 37 of the ring 28. The tongue 50 is provided at an intermediate position between the first and second ends 42*a*, 42*b* of each second leg 42. More particularly, the distance between the top wall 34 (i.e., the first ends 42*a* of the second legs 42) and the flexible tongues 50 is generally equal to or at least slightly larger than a height of the flanged head 26 of the stopper 14.

Referring to FIGS. 1 and 2, the cover 30 also has a generally cylindrical body and has a first end 30*a* and an opposing second end 30*b*. The cover 30 comprises a top wall 54 at its first end 30*a* and a skirt 56, and more particularly a cylindrical skirt 56, extending downwardly from the top wall 54 away from the first end 30*a*. The cover 30 has an interior cavity 57 defined by the top wall 54 and the skirt 56. The opposing second end 30*b* of the cover 30 is an open end. The top wall 54 is generally a closed wall, except for an opening 58 provided at its geometric center. The opening 58 extends completely through the top wall 54 and is configured to be generally aligned coaxially with the opening 22 of the container 12 and the opening 29 of the ring 28. The interior cavity 57 of the cover 30 preferably has a diameter (i.e., inner diameter of the cover 30) that is at least slightly greater than an outer diameter of the ring 28, such that the ring 28 is configured to be received within the interior cavity 57 of the cover 30.

An interior surface of the skirt 56 of the cover 30 preferably includes a rib or ledge 60 which protrudes inwardly toward the interior cavity 57 of the cover 30. More particularly, the ledge 60 is an annular ledge. The ledge 60 defines a catch designed to prevent separation of the cover 30 from the ring 28 by engaging the peripheral rim 38 of the top wall 34 of the ring 28 in a first position (for example, during a treatment process, such as lyophilization or sterlization) and by engaging the outwardly protruding ledges 46 of the first legs 40 and/or second legs 42 in a second position (for example, in a closed or sealed position), as described in more detail herein. The inwardly protruding ledge 60 is preferably provided closer to the open second end 30*b* of the cover 30 than to the first end 30*a*.

The various embodiments of the vial closure assemblies are not limited to the specific configuration of the ring and cover described above. For example, the ring and cover of the assemblies may alternatively be configured to not include an intermediate position and have differently configured locking tabs for securing the assembly to the collar of the vial, such as the components described in U.S. Pat. No. 8,714,384, the content of which is incorporated by reference herein in its entirety. As previously noted, the cover component is optional, and the vial closure assemblies disclosed herein may exclude the cover and include, for example, a cap and ring component that is configured similar to the cap and cover of the device described in U.S. Pat. No. 9,260,227, which is also incorporated by reference herein in its entirety.

Referring to FIGS. 1 and 2, the cap 32 of the vial closure assembly 10 is preferably generally circular in cross-section, and comprises a raised peripheral rim 62 and a central depressed region 64. An interior surface of the central depressed region 64 includes a plurality of spaced-apart bent tabs 66 configured to be engaged in the opening 58 of the cover 30. That is, in the engaged position, the bent tabs 66 extend through the opening 58 and abut the underside (or interior surface) of the top wall 54 of the cover 30. As such, the bent tabs 66 serve to couple the cap 32 to the cover 30. Thus, the cap 32 closes off the opening 58 of the cover 30 (as well as the opening 29 of the ring 28) and, before it is removed, shields access to the stopper 14 via the openings 58, 29. In embodiments of the vial closure assembly that exclude the optional cover 30, the cap 32 may be attached in a similar manner directly to the ring 28 by extending the tabs 66 through the opening 29 in the top wall 34 of the ring 28, for example. Alternatively, the cap 32 may be provided with a plurality of tabs that grasp the outer circumference of the top wall 34. In yet another embodiment, the top wall 34 may be provided with a plurality of apertures that are configured to lockingly mate with corresponding pins extending from the bottom surface of the cap 32, for example.

In one embodiment, the cap 32 includes an elastically deformable connecting web in the area between the peripheral rim 62 and the central depressed region 64, such that the peripheral rim 62 may be configured to move axially under drive from an axial pressure or force. Thus, the peripheral rim 62 may be configured to move between a raised position and a lowered position. In one embodiment, the peripheral rim 62 is also be biased to the raised position, such that the peripheral rim 62 automatically returns to the raised position when a pressure or force ceases to be applied to it.

The cap 32 functions as a spring element, and more particularly a flexible spring element, which provides for at least partial compensation of the heights of the stacked components of the assembly. More particularly, the cap 32 allows for the partial compensation of different heights of the various stacked components (e.g., the container 12, the stopper 14 and the vial closure assembly 10) of the assembly, and therefore reduces the risk of breakage of the container 12 during a treatment process. This benefit is particularly advantageous in the context of glass containers 12 being used in a lyophilization process.

Referring to FIGS. 1 and 2, a shell 70 is provided as the circumferentially outermost component of the vial closure assembly 10. The shell 70 is configured to captivate the cover 30, such that the shell 70 cannot be separated from the cover 30, but may rotate freely and independently of the cover 30. For example, the shell 70 may be preferably configured to include an main generally cylindrical barrel-shaped body 71. A top portion of the body 71 includes an upper inwardly radially extending lip 72 and the bottom portion includes an lower inwardly radially extending lip 74. The lower lip 74 radially extends to a diameter that is greater than or equal to the outer diameter of the ring 28, but less than the outer diameter of the second end 30*b* of the cover 30. The upper lip 72 radially extends to a diameter that is less than the outer diameter of the rim 62 of the cap 32 and less than the outer diameter of the first end 30*a* of the cover. Thus, the radial dimensions of the upper lip 72 and lower lip 74 are selected to captivate the cover 30, i.e. axial displacement of the shell 70 relative to the cover 30 is limited.

In order to limit the frictional contact between the shell 70 and the cover 30, the free end of the cantilevered upper lip 72 may be provided with at least one axially extending rail 76 for sliding contact on the top surface of the top wall 54 of the cover 30. The rail 76 extends in a direction that is generally parallel to the barrel 71 of the shell 70 and is preferably tapered to a narrow tip. The tip of the rail 76 rests on the top surface of the top wall 54 of the cover 30, thereby, providing the contact area between the cover 30 and the shell 70. The rail 76 may be configured in a single continuous circular shape or in order to further reduce the frictional contact between the cover 30 and the shell 70, the rail 76 may include gaps, such that the rail 76 is configured as a plurality of arcuate sections.

The barrel 71 of the shell 70 is preferably made from a hard material (e.g., a strong resilient plastic, such as acrylonitrile butadiene styrene (ABS)), such that the shell 70 will resist radial pinching forces that may cause contact between the barrel 71 and the skirt 56 of the cover 30. Maintaining an axial gap between the shell 70 and the cover 30 and reducing the frictional contact between the two components, thereby prevents the transfer of torque from the shell 70 to the cover 30 and reduces the likelihood of further transfer of torsional forces to the inner stopper 14 that may cause a leak if the flanged head 26 of the stopper 14 were to separate from the rim 20 of the container 12.

It will also be understood by those skilled in the art that the vial closure assembly 10 of the present invention may be utilized on a container made of any type of material and may be used in conjunction with a container for any type of treatment process (e.g., sterilization process, filling process and the like), and is in no way limited to glass containers and a lyophilization (freeze-drying) process.

When the cap 32 is removed by a user, a part of the upper (or exterior) surface 26*b* of the head 26 of the stopper 14 is exposed through the openings 58 and 29. The stopper 14 may thus be pierced, for example, by a needle of a syringe (not shown) for introducing a liquid solvent or diluent into the container 12 and/or drawing out a liquid drug product from the container 12, for example.

A description of one of the methods for assembling the vial closure assembly 10 follows. The successive steps which may be utilized for joining the vial closure assembly 10 (including the stopper 14 pre-assembled therewith) together with the container 12 (e.g., for pre-assembly or for a treatment process, in a first position) and, finally, for closing the container 12 in a sealed manner by the vial closure assembly 10 (i.e., a second position) are also described.

During assembly of the vial closure device 10, the stopper 14 is positioned within the ring 28, as shown in FIG. 1. More particularly, the stopper 14 is inserted into the interior cavity 37 of the ring 28 via the bottom end 28*b* and pushed in an upward direction toward the first end 28*a* and the top wall 34. By this insertion motion, the head 26 of the stopper 14 comes into contact with the surfaces of the tongues 50. As the head 26 of the stopper 14 passes over the tongues 50, the head 26 causes the tongues 50 to flex toward and retract inside of the respective recesses 52. After the head 26 of the stopper 14 has moved past the tongues 50, the tongues 50 spring back out of the recesses 52 and return to their previously biased position (i.e., to extend inwardly toward the interior cavity 37 and out of the recesses 52), and then engage the head 26 of the stopper 14. More particularly, the tongues 50 snap back to engage the underside (i.e., the lower or interior surface 26*a*) of the head 26 of the stopper 14, so as to retain the stopper 14 between the tongues 50 and the top wall 34, as shown in FIG. 1. More particularly, in this pre-assembly position, the upper surface 26*b* of the head 26 of the stopper 14 faces, and may even abut or be in direct contact with, the top wall 34 of the ring 28. As such, the stopper 14 is secured within the ring 28, between and by the top wall 34 and the tongues 50 of the second legs 42 of the skirt 36 of the ring 28.

In a separate step and if present, the cover 30 is captivated within the shell 70. This may be accomplished by providing a shell 70 that lacks either an upper lip 72 or a lower lip 74, inserting the cover 30, and then providing the shell 70 with either the upper lip 72 or lower lip 74. In one embodiment, the cover 30 is inserted into the shell 70 through the end lacking a lip, and after insertion, a press or similar tool may be used to inwardly flare the end of the shell to form the upper lip 72 or lower lip 74. Preferably, the lower lip 74 is the lip that is formed by the flaring step after inserting the cover 30 due to the complexity of the shape of the upper lip 72 and the associated rail 76. In a less preferred embodiment, the upper and/or lower lip may be provided as a separate ring or washer that is bonded to the end of the shell 70 after the cover 30 is inserted into the barrel 71 of the shell 70.

Next, the ring 28, with the stopper 14 secured therein, is partially inserted into the interior cavity 57 of the cover 30 through the open second end 30*b*. In one embodiment, prior to the partial insertion of the assembled ring 28 and stopper 14 into the interior cavity 57 of the cover 30, the cap 32 has already been coupled to the cover 30, as described above, such that the spaced-apart tabs 66 of the cap 32 are engaged with the underside of the top wall 54 of the cover 30. As previously noted, if the cover 30 is absent, the ring 28 may be inserted into the shell 70 lacking an upper lip 72 or lower lip 74, as described above, followed by the steps of providing a upper or lower lip and finally, attachment of the cap 32.

The process of partially inserting the assembled ring 28 and stopper 14 into the interior cavity 57 of the cover 30 will now be described. Specifically, starting with the top wall 34, the assembled ring 28 and stopper 14 pass through the open second end 30*b* of the cover 30 and are pushed in an upward direction toward the top wall 54 of the cover 30 (or vice versa the cover 30 is pushed in a downward direction toward the top wall 34 of the ring 28). This insertion motion continues until the peripheral flange 38 of the top wall 34 of the ring 28 passes over and then comes to rest on the inwardly protruding ledge 60 of the cover 30. During the insertion motion, the skirt 36 of the ring 28, and more particularly the first and second legs 40, 42, may deform at least slightly radially inwardly. In an assembled position, the peripheral flange 38 of the top wall 34 of the ring 28 is positioned above and on the inwardly protruding ledge 60 of the cover 30, such that ledge 60 of the cover 30 abuts and directly contacts the lower surface or underside 38*a* of the peripheral flange 38. As such, a portion of the assembled ring 28 and stopper 14 is received within the interior cavity 57 of the cover 30, while the remaining portion of the assembled ring 28 and stopper 14 is positioned outside of the cover 30, as shown in FIG. 1.

At this stage, the closure device 10 is in its assembled position or state. The assembled closure device 10 may then be subjected to a preliminary treatment process, such as a sterilization process.

Next, the assembled closure device 10 is positioned on the container 12 in a first position, as shown in FIG. 1. To do so, the assembled vial closure device 10 is positioned over the container 12, such that the rim 20 of the container 12 is received within the ring 28. More particularly, the assembled vial closure device 10 is pushed in a downward direction over the container rim 20 (or vice versa the container 12 is pushed in an upward direction toward the top wall 34 of the ring 28) until the container rim 12 is positioned between the upper ledges 44 of the first legs 40 and the lower ledges 48 of the second legs 42 of the skirt 36 of the ring 28. As such, the container rim 12 is secured within the ring 28 and serves to center the assembled vial closure device 10 and the container 12 relative to each other, such that the assembled vial closure device 10 is held in a stable manner on the container 12. In this first position, the tapered end 24*a* of the cylindrical body 24 of the stopper 14 is positioned at the entry of the opening 22 of the container 12, but the cylindrical body 24 itself may not yet be fully received within the opening 22 of the container 12.

As such, in the first position, the assembled closure device 10 and container 12 joined thereto may be subjected to one or more of a variety of treatment processes. As a non-limiting example, the assembled closure device 10 and container 12 joined thereto, in the first position, may be subjected to a lyophilization (i.e., freeze-drying) process. Because the cylindrical body 24 or the tapered end 24*a* of the stopper 14 is not yet inserted within the opening 22 of the container 12, water vapor released during the lyophilization process is able to escape from the container 12.

After the treatment process or processes are complete, the container 12 can be finally closed and sealed by the vial closure assembly 10 (i.e., placed into the second position). It will be understood by those skilled in the art that the processes described herein may be simultaneously carried out on multiple containers 12 and vial closure assemblies 10, providing for bulk assembly, treatment and closure.

To effect complete closure and sealing of the container 12, after the treatment process is complete, pressure or force (e.g., by a pressing plate) may be exerted in a downward direction on the cap 32, and this pressure or force then translates through the vial closure assembly 10. Alternatively, pressure or force may be exerted in an upward direction on the container 12, which in turn exerts pressure or force in an upward direction on the vial closure assembly 10. The following discussion regarding closure of the container 12 relates to the embodiment wherein force is exerted in the downward direction on the cap 32, but it will be understood by those skilled in the art that the relative movement of the vial closure assembly 10 and container 12 should be the same regardless of the direction of application of pressure or force.

For example, when pressure or force is applied in the downward direction on the cap 32, the pressure/force causes the container rim 20 to come out of the annular seat defined by the upper ledges 44 of the first legs 40 and the lower ledges 48 of the second legs 42 of the ring 28, and moves in an upward direction toward the top wall 34 of the ring 28 and past the upper ledges 44 of the first legs 40 and the flexible tongues 50 of the second legs 42. During this upward motion, the cylindrical body 24 of the stopper 14 simultaneously moves into the opening 22 of the container 12, and the container rim 20 comes into contact with the surfaces of the flexible tongues 50, thus causing the tongues 50 to again retract inside the respective recesses 52. This motion continues until the cylindrical body 24 of the stopper 14 is fully received within the opening 22 of the container 12, and until the container rim 20 rests against the underside 26*a* of the head 26 of the stopper 14 and is secured within the area between the underside 26*a* of the head 26 of the stopper 14 and the upper ledges 44 of the first legs 40. In parallel to movement of the stopper 14, the first legs 40 deform or bend radially outwardly until the inner diameter of the upper ledges 44 equals the outer diameter of the container rim 20 of the container 12. The first legs 40 will deform or bend radially inwardly again, once the stopper 14 is pushed into the opening 22 of the container 12, such that the upper ledges 44 of the first legs 44 engage the underside of the container rim 20 for final container fixation, as illustrated in FIG. 2.

To help prevent particles of the plastic material of the closure device 10 from entering the container 12, the relative movement between the cover 30 and the ring 28 may start once the stopper 14 is completely pushed into the opening 22 of the container 12. This pressure/force also causes the inwardly protruding ledge 60 of the cover 30 and the peripheral flange 38 of the ring 28 to come out of engagement with each other, and the cover 30 to move in a downward direction toward the container 12 until the inwardly protruding ledge 60 engages and abuts against the outwardly protruding ledges 46 of the ring 28, and until the top wall 34 of the ring 28 is proximate (or abuts) the top wall 54 of the cover 30.

At this stage, the vial closure assembly 10 is securely locked to the container 12, such that the container 12 is closed and sealed in a secure and leak-tight manner. Furthermore, the provision of the outer shell 70 reduces the likelihood that the achieved seal may be lost as a result of the application of torque to the vial closure assembly 10.

Certain terminology is used in the following description for convenience only and is not limiting. The words "proximal," "distal," "upward," "downward," "bottom" and "top" designate directions in the drawings to which reference is made. The words "inwardly" and "outwardly" refer to directions toward and away from, respectively, a geometric center of the closure device and container and/or designated parts thereof, in accordance with the present invention. Unless specifically set forth herein, the terms "a," "an" and "the" are not limited to one element, but instead should be read as meaning "at least one." The terminology includes the words noted above, derivatives thereof and words of similar import.

It will be appreciated by those skilled in the art that changes could be made to the embodiments described above without departing from the broad inventive concept thereof.

It is understood, therefore, that this invention is not limited to the particular embodiments disclosed, but it is intended to cover modifications within the spirit and scope of the present invention as defined by the appended claims.

I claim:

1. A vial closure assembly comprising:

a ring comprising a first top wall and a skirt extending downwardly from the first top wall, the first top wall defining a first central through-opening, and the skirt comprising a plurality of locking tabs;

a cover comprising a second top wall and a sidewall extending downwardly from the second top wall, the second top wall and the sidewall defining an interior cavity, and the second top wall defining a second central through-opening aligned with the first central through-opening of the ring;

a cap comprising a plurality of tabs configured to engage the second top wall of the cover; and a shell comprising a body having an upper lip extending radially inward and a lower lip extending radially inward, the upper lip including at least one rail configured to contact a top surface of the second top wall when the shell engages the cover.

2. The vial closure assembly of claim 1, wherein the shell is configured to rotate independently of the cover.

3. The vial closure assembly of claim 1, wherein the at least one rail is tapered and a tip of the at least one rail is configured to contact the top surface of the second top wall when the shell engages the cover.

4. The vial closure assembly of claim 1, wherein the shell comprises a plurality of rails.

5. The vial closure assembly of claim 4, wherein each rail of the plurality of rails is arcuate.

6. The vial closure assembly of claim 1, wherein the ring, the cover, the shell, and the cap are made of a plastic material.

7. The vial closure assembly of claim 6, wherein the plastic material is a pharmaceutical grade plastic material.

8. The vial closure assembly of claim 1, wherein the skirt further comprises a flexible tongue and a recess configured to receive the flexible tongue.

9. The vial closure assembly of claim 1, further comprising an elastomeric stopper comprising a flanged head and a cylindrical body extending downwardly from the flanged head, the elastomeric stopper being housed within the skirt of the ring.

10. A sealed container assembly comprising:

a container having a main body, a neck, and a rim defining an opening of the container; and the vial closure assembly according to claim 9, wherein the elastomeric stopper is in sealing contact with the opening of the container, and wherein the plurality of locking tabs engage a bottom surface of the rim.

11. The vial closure assembly of claim 1, wherein the body of the shell is barrel-shaped.

12. A vial closure assembly comprising:

a ring comprising a top wall and a skirt extending downwardly from the top wall, the top wall defining a first central through-opening, and the skirt comprising a plurality of locking tabs;

a cap comprising a plurality of tabs configured to engage the top wall of the ring; and a shell comprising a body having an upper lip extending radially inward and a lower lip extending radially inward, the upper lip including at least one rail configured to contact a top surface of the top wall of the ring when the shell engages the ring.

13. The vial closure assembly of claim 12, wherein the at least one rail is tapered and a tip of the at least one rail is configured to contact the top surface of the top wall of the ring when the shell engages the ring.

14. The vial closure assembly of claim 12, wherein the shell comprises a plurality of rails.

15. The vial closure assembly of claim 14, wherein each rail of the plurality of rails is arcuate.

16. The vial closure assembly of claim 12, wherein the ring, the shell, and the cap are made of a plastic material.

17. The vial closure assembly of claim 16, wherein the plastic material is a pharmaceutical grade plastic material.

18. The vial closure assembly of claim 12, wherein the skirt further comprises a flexible tongue and a recess configured to receive the flexible tongue.

19. The vial closure assembly of claim 12, further comprising an elastomeric stopper comprising a flanged head and a cylindrical body extending downwardly from the flanged head, the elastomeric stopper being housed within the skirt of the ring.

20. A sealed container assembly comprising:

a container having a main body, a neck, and a rim defining an opening of the container; and the vial closure assembly according to claim 19, wherein the elastomeric stopper is in sealing contact with the opening of the container, and wherein the plurality of locking tabs engage a bottom surface of the rim.

21. The vial closure assembly of claim 12, wherein the body of the shell is barrel-shaped.

* * * * *